US005363900A

United States Patent [19]

Betz

[11] Patent Number: 5,363,900

[45] Date of Patent: Nov. 15, 1994

[54] STEEL MOLD ESPECIALLY FOR PERMANENT MOLD CASTING OF METAL

[75] Inventor: Gerhard Betz, Mülheim a.d. Ruhr, Germany

[73] Assignee: Thyssen Guss AG, Mülheim, Germany

[21] Appl. No.: 48,813

[22] Filed: Apr. 16, 1993

[30] Foreign Application Priority Data

Apr. 16, 1992 [DE] Germany ..... 4212787

[51] Int. Cl.[5] ..... B22C 9/06; B22D 17/22; B22D 27/04

[52] U.S. Cl. ..... 164/348; 164/303; 249/80; 425/552

[58] Field of Search ..... 164/348, 303; 249/80, 249/135; 425/552

[56] References Cited

U.S. PATENT DOCUMENTS

| | | | |
|---|---|---|---|
| 3,913,660 | 10/1975 | Diez | 164/348 |
| 4,966,544 | 10/1990 | Mitake | 425/552 |

FOREIGN PATENT DOCUMENTS

| | | | |
|---|---|---|---|
| 47-512 | 1/1972 | Japan | 164/348 |
| 62-117716 | 5/1987 | Japan | 164/348 |
| 2-41760 | 2/1990 | Japan | 164/348 |
| 2-207958 | 8/1990 | Japan | 164/348 |
| 831305 | 5/1981 | U.S.S.R. | 164/348 |
| 839682 | 6/1981 | U.S.S.R. | 164/348 |

*Primary Examiner*—J. Reed Batten, Jr.
*Attorney, Agent, or Firm*—Robert W. Becker & Associates

[57] ABSTRACT

A steel mold has a mold body with a molding surface and heat-conducting members with a first and a second end embedded in the mold body. The heat-conducting members have a length and a thickness and are made of a material having a melting point above 950° C. The heat-conducting members are spaced at a distance from the molding surface wherein a ratio of the thickness to the distance is 1:1 to 1:3 and wherein the length is 3 to 10 times the thickness. A cooling system is embedded within the mold body whereby one of the ends of the heat conducting members is connected to the cooling system.

19 Claims, 1 Drawing Sheet

STEEL MOLD ESPECIALLY FOR PERMANENT MOLD CASTING OF METAL

BACKGROUND OF THE INVENTION

The present invention relates to a steel mold, especially made of highly heat-resistant hot casting steel for metal casting in permanent mold casting processes.

It is known to provide steel molds for aluminum casting with channels through which a cooling medium may flow in order to shorten the casting cycle and to prevent hot spots within the area of thicker portions of the molded material. These cooling channels, conventionally produced by providing bores in the rearward side of the massive steel mold are always positioned at a relatively great distance to the mold surface of at least 20 to 30 mm in order to prevent cracks and breakage due to thermally induced local tension.

Due to this relatively great distance of the cooling channels to the hot mold surface, only a small portion of the heat introduced into the mold by casting the liquid metal can be removed via the heat dissipation means through the steel mold so that during manufacture the heat dissipation is achieved mainly by spraying water directly onto the contour of the mold after opening the mold and removing the molded component. The resulting thermal tensions lead to fatigue cracks within the steel mold surface due to the use of the permanent mold for repeated casting cycles and thus a shortened service life of such a steel mold. In many cases already after 20,000 castings such a steel mold or a portion of the steel mold must be renewed.

It is therefore an object of the present invention to provide a permanent steel mold especially for mold casting metal, such as aluminum die-casting, with which the disadvantages of the known steel molds are eliminated, the risk of cracking of the steel mold is substantially reduced, and the time for each working cycle can be reduced by at least 30%.

BRIEF DESCRIPTION OF THE DRAWINGS

This object, and other objects and advantages of the present invention, will appear more clearly from the following specification in conjunction with the accompanying drawings, in which:

FIG. 3 is a plan view of the pin arrangement with a meander pattern of the foil strip;

FIG. 4 is a plan view of the pin arrangement with a honeycomb pattern of the foil strip;

FIG. 5 is a cross-sectional view of a steel mold with a slotted copper cylinder; and FIG. 6 is a section along line I—I in FIG. 5.

SUMMARY OF THE INVENTION

Figure 1:
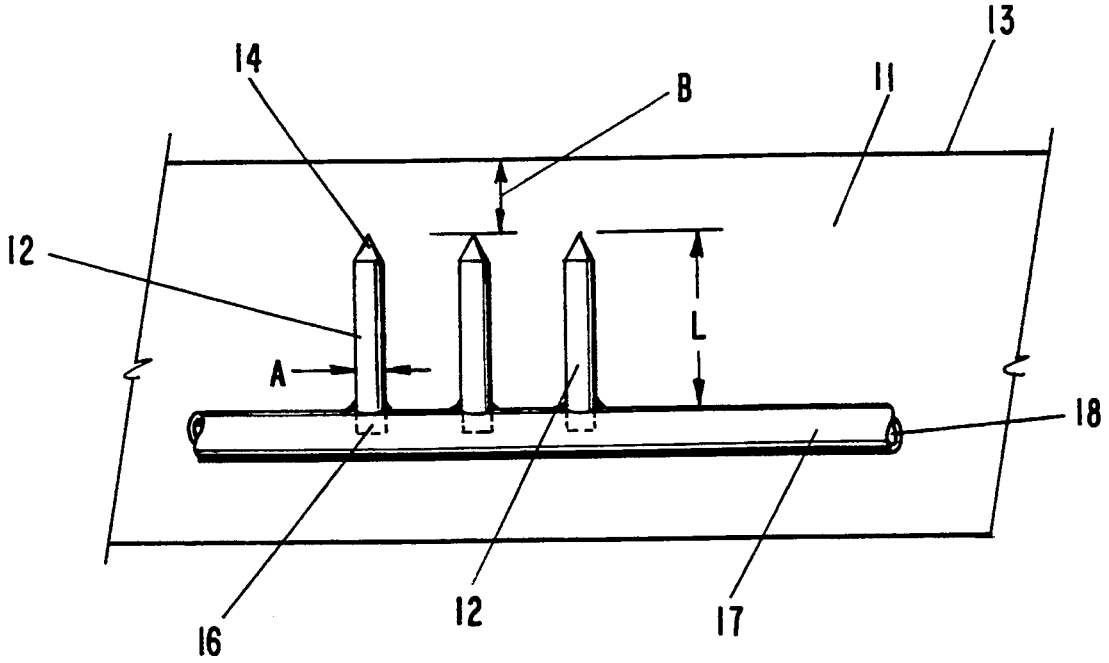
FIG. 1 shows a detail of a steel mold.

The steel mold of the present invention is primarily characterized by:

A mold body with a molding surface;

Heat-conducting members with a first and a second end embedded in the mold body, wherein the heat-conducting members have a length L and a thickness A and are made of a material having a melting point above 950° C.;

The heat conducting members being spaced at a distance B from the molding surface, wherein a ratio of the thickness A to the distance B is A:B =1:1 to 1:3 and wherein the length L is three to ten times the thickness A; and A cooling system embedded within the mold body, with one of the ends of the heat-conducting members connected to the cooling system.

Preferably, the heat-conducting members extend perpendicularly to the molding surface, with the first end being spaced at the distance B from the molding surface and with the second end connected to the cooling system.

Preferably, the steel mold further comprises a foil strip made of a material resistant up to a temperature of 950° C. embedded in the mold body, the foil strip having a minimum thickness of 0.05 mm and a maximum thickness of 0.5 mm, the foil strip extending perpendicularly to the molding surface to a depth of maximum 20 mm into the mold body and being wound about the heat-conducting members in a pattern. This pattern can be a meander pattern or a honeycomb pattern. Expediently, the foil strip is connected, preferably by soldering, to the cooling system. Advantageously, the foil strip has a diffusion-preventing coating. The heat conducting members can be in the form of pins or tubes.

In an alternative embodiment, the heat conducting members extend parallel to the molding surface spaced at the distance B, the heat-conducting members being vertical segments of a slotted cylindrical body.

Preferably, the heat conducting members are made of copper.

Expediently, the heat-conducting members are arranged in constricted areas of the steel mold.

It is expedient that the cooling system is prefabricated and embedded into the mold body during manufacture of the steel mold, during which manufacture a blank is formed in a powder metallurgical process, the blank then being machined to produce the steel mold. Preferably, the blank is machined by a cutting process. The blank is preferably produced by a hot isostatic pressing process. Preferably, a matrix is used during the hot isostatic pressing process, the matrix being made of a material that is resistant up to a temperature of 950° C. The matrix also serves for the positioning and fixation of the cooling system during the hot isostatic pressing process.

Advantageously, the steel mold further comprises at least one therocouple embedded within the mold body in the vicinity of the molding surface for controlling cooling of the steel mold. The thermal couple is preferably positioned adjacent to a surface of the heat-conducting members closest to the molding surface.

Inventively, the steel mold has a heat-dissipating network arranged below the molding surface and adapted as closely as possible to the mold contour. The network is preferably comprised of a material that has good heat-conducting properties and a melting point above 950° C. This heat-dissipating network comprises two separate components, the first being a heat-dissipating system comprised of pins or tubes extending perpendicular to the molding surface or a slotted cylindrical body extending parallel to the moldings surface, both alternative systems spaced at a distance to the molding surface that is one to three times their thickness. The second component is a conventional coding system comprised of tubes carrying a cooling medium.

Inventively, the heat dissipating system in the form of heat-conducting members is preferably comprised of copper and fixedly connected to the cooling system by soldering or welding. The cooling system, comprised of tubes, dissipates the heat removed by the heat-conducting members from the steel mold with a cooling medium flowing within the cooling tubes. The cooling system is arranged approximately 20 to 30 mm below the molding surface so that cracks or breakage cannot occur.

The heat dissipating system, in order to prevent continuously extending tension cracks, must be embedded within the mold body without voids. Due to the heat-conducting members being spaced at a small distance from one another the inventive heat-dissipatingn system leads to an increased heat dissipation from the hot steel mold surface into the area below the steel mold to the cooling system. For the further reduction of thermal tension within the surface area it is suggested with the present invention to provide in addition to the aforementioned heat dissipation system an artificial cracking network within the surface area of the steel mold, comprised of a foil strip that is resistant up to temperatures 950° C. with a minimum thickness of 0.05 mm and a maximum thickness of 0.5 mm. This foil strip is provided in a meander or honeycomb pattern between the heat-conducting members directly below the molding surface and extends to a depth of maximal 20 mm. Advantageously this foil strip is made of copper.

The advantage of the inventive steel mold is that the casting cycles can be considerably shortened, for example, from 75 seconds to 45 seconds, which is an exceptional improvement of the manufacturing process, but that at the same time the risk of cracking of the steel mold is considerably reduced.

DESCRIPTION OF PREFERRED EMBODIMENTS

The present invention will now be described in detail with the aid of several specific embodiments utilizing FIGS. 1 through 6.

Figure 2:
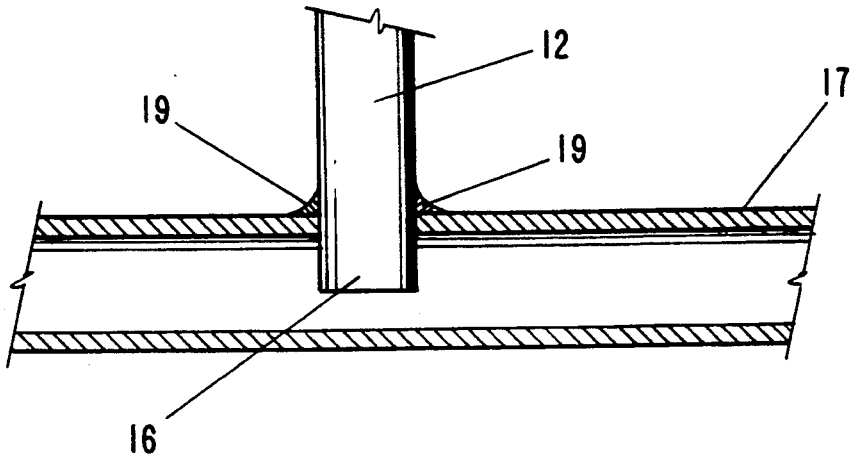
FIG. 2 shows an enlarged detail of FIG. 1.

According to FIGS. 1 to 3 a heat-dissipating system is arranged within the steel mold, respectively, the mold body 11 and is comprised of copper pins 12 which are arranged perpendicularly to the molding surface 13. The pins 12 have a head 14 spaced at a distance B of approximately 3 mm from the molding surface or mold contour (hot side or surface of the mold). They have a length L that corresponds to 3 to 10 times their thickness A. The distance 3 B is 1 to 3 times the thickness A of the pins 12. The head 14 of each pin 12 is pointed. The rearward end 16 of each pin 12 extends to a tube 17 of the cooling system which tube 17 extends essentially parallel to the molding surface 13 of the steel mold and through which a cooling medium such as water 18 is guided. FIG. 2 shows the rearward end 16 of the pin 12 that is tightly connected by a soldering or welding seam 19 to the water-guiding tube 17. According to FIG. 3 for cooling a greater portion an arrangement of pins 12 is represented whereby, in order to compensate tension, a foil strip 20, 21 is arranged in a meander pattern 20 or honeycomb pattern 21 about the pins 12. When it is desired to cool only a very small portion of the steel mold, the pins 12 can be arranged in rows about which the foil strip is wound. The foil strip 20, 21 may be comprised of a copper foil of 0.05 to 0.5 mm thickness or a stainless steel foil. The foil strip can be provided with a diffusion-preventing layer in order to prevent that the foil during the manufacturing process of the blank of the steel mold dissolves within the steel.

According to FIG. 5 and FIG. 6 the heat dissipating system can also be provided in the form of a slotted cylinder with vertical cylinder segments, for example, in the form of a slotted cylinder mantle made of copper 22. Such an arrangement is especially suitable for steel mold inserts of a considerable length, whether they are cylindrical, annular, or pocket-shaped. A cooling system 23 is connected to the heat-dissipating component in the form of cylindrical segments 22, spaced at a distance B from the molding surface 13*a* that corresponds to 1 to 3 times the thickness A of the cylindrical segments.

For manufacturing the steel mold according to the present invention a cooling system is prefabricated and subsequently incorporated into the blank of the steel mold by a powder metallurgical process, the blank then being finished in a manner known per se to the steel mold or a steel mold insert, for example, by a cutting process.

For manufacturing the steel mold, the cooling system is connected and fixed within a container or on a solid support such that the distance of the heat-conducting members from the finished molding surface is as close as possible to the desired finished distance. Advantageously, a negative mold or matrix corresponding to the desired shape of the steel mold is used which is highly heat resistant in order to achieve a blank which corresponds as closely as possible to the final steel mold contour after the powder metallurgical manufacturing process.

The head of the pins or tubes 12 can be chamfered, rounded or pointed depending on the requirements for the steel mold. The cylinder segments 22 can be slotted, provided with holes or perforated with any other geometric shape in order to reduce the separation effect within the steel mold.

In order to be able to control and adjust the cooling water supply and thus the temperature within the steel mold a thermocouple is embedded within the steel body close to the molding surface. This thermal couple is embedded together with a cooling system during the powder metallurgical manufacturing process.

The steel mold of the present invention can be used where steel is exposed to higher temperatures and the heat is supplied or dissipated in a controlled manner. Steel molds are, for example, being used in die-casting, gravity casting, and low pressure ingot molding processes, in plastic injection molding processes, and drop-forging. However, the present invention may also be applied in pouring systems, such as for the filling chamber of a pressure casting machine.

The present invention is, of course, in no way restricted to the specific disclosure of the specification and drawings, but also encompasses any modifications within the scope of the appended claims.

What I claim is:

1. A steel mold comprised of:

a mold body with a molding surface;

heat-conducting members with a first and a second end embedded in said mold body, wherein said heat-conducting members have a length L and a thickness A and are made of a material having a melting point above 950° C.;

said heat-conducting members being spaced at a distance B from said molding surface, wherein a ratio of said thickness A to said distance B is A:B=1:1 to 1:3 and wherein said length L is 3 to 10 times said thickness A; and a cooling system embedded within said mold body, with one of said ends of said heat conducting members connected to said cooling system.

2. A steel mold according to claim 1, wherein said heat-conducting members extend perpendicularly to said molding surface, with said first end being spaced at said distance B from said molding surface and with said second end connected to said cooling system.

3. A steel mold according to claim 2, further comprising a foil strip made of a material resistant up to a temperature of 950° C. and embedded in said mold body, said foil strip having a minimum thickness of 0.05 mm and a maximum thickness of 0.5 mm, said foil strip extending perpendicularly to said molding surface to a depth of maximal 20 mm into said mold body and being wound about said heat-conducting members in a pattern.

4. A steel mold according to claim 3, wherein said pattern is a meander pattern.

5. A steel mold according to claim 3, wherein said pattern is a honeycomb pattern.

6. A steel mold according to claim 3, wherein said foil strip is connected to said cooling system.

7. A steel mold according to claim 6, wherein said foil strip is soldered to said cooling system.

8. A steel mold according to claim 3, wherein said foil strip has a diffusion-preventing coating.

9. A steel mold according to claim 2, wherein said heat-conducting members are pins.

10. A steel mold according to claim 2, wherein said heat-conducting members are tubes.

11. A steel mold according to claim 1, wherein said heat-conducting members extend parallel to said molding surface spaced at said distance B, said heat-conducting members being vertical segments of a slotted cylindrical body.

12. A steel mold according to claim 1, wherein said heat-conducting members are made of copper.

13. A steel mold according to claim 1, wherein said heat-conducting members are arranged in constricted areas of said steel mold.

14. A steel mold according to claim 1, wherein said cooling system is prefabricated and embedded into said steel mold during manufacture of said steel mold, during which manufacture a blank is formed in a powder metallurgical process, the blank then being machined to produce said steel mold.

15. A steel mold according to claim 14, wherein the blank is machined by a cutting process.

16. A steel mold according to claim 14, wherein the blank is produced by a hot isostatic pressing process.

17. A steel mold according to claim 16, wherein a matrix is used during the hot isostatic pressing process, the matrix made of a material that is resistant up to a temperature of 950° C., the matrix also serving for the positioning and fixation of said cooling system during the hot isostatic pressing process.

18. A steel mold according to claim 1, further comprising at least one thermocouple embedded within said mold body in the vicinity of said molding surface for controlling cooling of said steel mold.

19. A steel mold according to claim 18, wherein said thermocouple is positioned adjacent to a surface of said heat-conducting members closest to said molding surface.

* * * * *